US005951419A

United States Patent [19]

Cameneti

[11] Patent Number: 5,951,419

[45] Date of Patent: Sep. 14, 1999

[54] FUNNEL-FINN ARROW FLETCHINGS/ VANES

[75] Inventor: Michael Alan Cameneti, 7358 Genesta Ave., Van Nuys, Calif. 91406

[73] Assignee: Michael Alan Cameneti, Van Nuys, Calif.

[21] Appl. No.: 08/947,471

[22] Filed: Mar. 24, 1997

[51] Int. Cl.[6] ..... F42B 6/06

[52] U.S. Cl. ..... 473/586

[58] Field of Search ..... 473/578, 586, 473/FOR 216, FOR 223

[56] References Cited

U.S. PATENT DOCUMENTS

| | | | |
|---|---|---|---|
| 3,746,334 | 7/1973 | Stubblefield | 473/586 X |
| 3,815,916 | 6/1974 | Meszaros | 473/586 |
| 4,204,307 | 5/1980 | Pfetzing | 473/586 X |
| 5,311,855 | 5/1994 | Basik | 473/586 X |
| 5,439,231 | 8/1995 | Roberts et al. | 473/586 |

FOREIGN PATENT DOCUMENTS

| | | | |
|---|---|---|---|
| 498823 | 1/1939 | United Kingdom | 473/FOR 223 |
| 620536 | 3/1949 | United Kingdom | 473/FOR 223 |

*Primary Examiner*—John A. Ricci

[57] ABSTRACT

An arrow having a substantially cylindrical shaft with front and rear ends. A single piece fletching mounted on the shaft adjacent the rear end thereof and the fletching having a cylindrical front part with a flared rear cone connected to the front part which projects back and outward defining a substantially larger circumference and providing said fletching with a funnel shaped appearance. A plurality of fins disposed on the flared rear cone wherein the fins are angularly disposed with respect to each other and to the longitudinal axis of the fletching. Each of the vanes is of a wedge shaped cross section with a flat front directional face and a rearward sloping ramp face.

2 Claims, 2 Drawing Sheets

FUNNEL-FINN ARROW FLETCHINGS/ VANES

FIELD OF INVENTION

This invention relates to the field of archery, specifically to fletchings/vanes used to stabilize the flight of an arrow.

DESCRIPTION OF PRIOR ART

Arrows conventionally include fletchings mounted on their rear ends to provide flight stability. Usually three and sometimes four fletchings are mounted in a circumferentially spaced relationship about the rear end of the arrow shaft. Traditionally feathers were used. Later through the invention of different moulding materials and techniques various plastics, vinyls, and other flexible materials began to replace feathers as an acceptable material. However the tradition of multiple piece fletchings has for the most part remained constant. Each fletching or vane must be glued in place separately either by hand or with the aid of a fletching jig.

The trouble with installing fletchings or vanes individually is that the process is time consuming and more importantly inconsistencies can occur. Inconsistencies in the form of unevenly spaced fletchings, slight angle changes, and varying distances from the end of the arrow shaft. All of these inconsistencies can have profound effect on the flight of an arrow.

SUMMARY AND OBJECTS OF THE INVENTION

The above problems are avoided by the invention which provides an elongated funnel shaped sleeve having an open-ended bore for invariably receiving the end of an arrow shaft. The exterior of the sleeve carries a plurality of outwardly extending fins that are angularly disposed with respect to each other.

It is therefore an object of the invention to provide a one piece fletching that eliminates the inconsistencies associated with traditional multi-piece fletching systems.

A further object of this invention is to attain the above object with a fletching that is simple both to manufacture and install.

The present invention achieves the above objects and others by providing a single piece fletching that is installed on the rear end of an arrow shaft as a one piece unit. The invention is a very thin flexible funnel shaped molded part that is taped or glued in place.

BRIEF DESCRIPTION OF DRAWINGS

In the drawings, closely related figures have the same number with different alphabetical suffixes.

DETAILED DESCRIPTION

Figure 1:
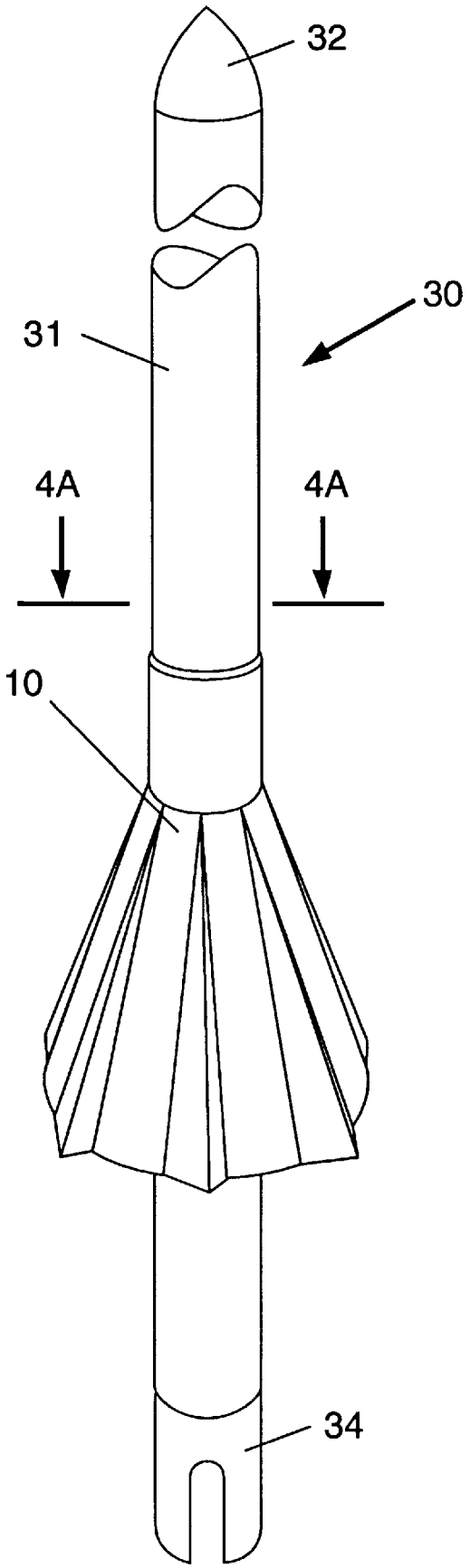
FIG. 1 is a side perspective view of an arrow equipped with a fletching unit embodying the features of the invention.

Turning now to the drawings, FIG. 1 is a side perspective view of arrow 30 in accordance with the invention that includes a substantially cylindrical, elongated shaft 31. The shaft 31 may be one of a number of recognized compositions such as wood, aluminum or carbon. However, the invention most dramatically improves the performance of light weight arrow compositions such as aluminum and carbon.

The advent of high speed aluminum and carbon shaft arrows, and other technological advances in the field of competitive archery equipment, has been marked by suboptimal performances which the inventor has found to be partially attributable to the characteristics of conventional arrow fletchings and the method to which they must be independently attached to the arrow shaft. The inventor has found that the inconsistencies attributed to independent attachment of fletchings to the arrow shaft to be a source of flutter causing less than optimal flight conditions. These less than optimal flight conditions can cause inconsistencies from one arrow to the next resulting in a larger "grouping"especially noticeable at long distances.

The front end of the shaft 31 terminates in a point 32 while a nock 34 is fixed to its opposed or rearward end. A singular funnel shaped fletching 10 is fixed adjacent the shaft's rearward end.

Figure 2:
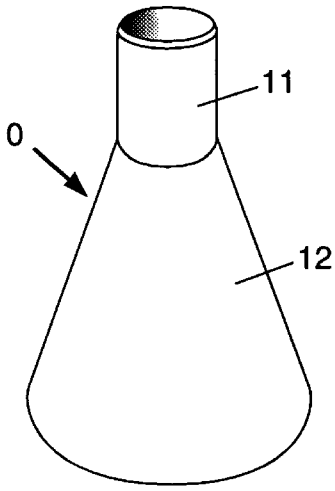
FIG. 2 is a side perspective view showing the basic form of the funnel shaped one piece fletching/vane preparatory to mounting angular fins.

FIG. 2 is a side perspective view in accordance with the basic single piece funnel shape of the invention preparatory to mounting of angular fins. A single piece fletchings is formed through an injection molded process utilizing very thin, lightweight, and flexible material such as various plastics and/or vinyls. The single piece fletching 10 has two basic parts which comprise its shape. The cylindrical front end 11 of the fletching fits precisely around the arrow shaft 31, while the cone shaped rear end 12 of the fletching projects back and outward 360 degrees from the arrow shaft 31 to create a 360 degree "drag"surface necessary to stabilize the arrow while in flight. The invention's unique one piece design and 360 degree drag surface virtually eliminates flutter caused by irregular mounting and unevenly spaced fletchings. Its one piece design also allows the invention to be easily and quickly attached by simply sliding onto the rearward end of the arrow shaft 31 and taping (preferably) or gluing in place.

Figure 2A:
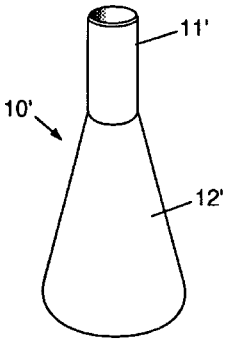
FIG. 2A and 2B are side perspective views showing the basic form of the funnel shaped fletching/vane in varying elongated or truncated sizes.
Figure 2B:
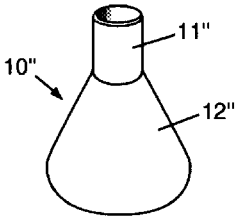

FIG. 2A and FIG. 2B are side perspective views in accordance with the basic funnel shape of the invention as described in FIG. 2 showing alternative elongated or truncated designs to allow for different archer's needs and/or preferences. The drawings 2A and 2B are ment to demonstrate how the basic form 10 can vary in length and width but not limited to the scale of said drawings.

Figure 3:
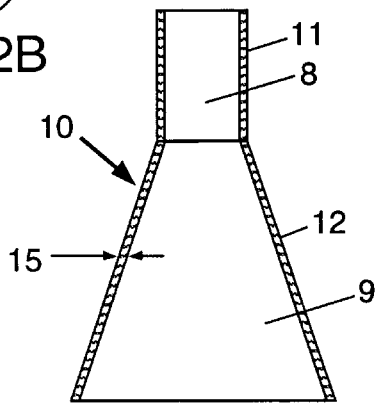
FIG. 3 is a longitudinal cross section of the basic funnel shaped one piece fletching/vane.

FIG. 3 is a longitudinal cross section of the basic funnel shape indicating its open ended bore having a cylindrical front part 8 and a flared cone shaped rear 9. As can be seen the front end 11 of the fletching has straight sides while the rear end 12 of the fletching projects outward from the center at a precise and consistent angle. The wall thickness 15 will be as thin as possible (most likely between 0.003 and 0.015 inches thick) given the limitations of the various plastics and/or vinyls while still maintaining the integrity of the funnel shape of the invention.

Figure 4:
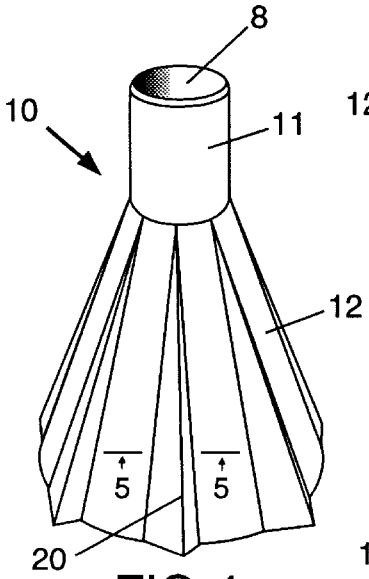
FIG. 4 is a side perspective view showing the basic form of the funnel shaped one piece fletching with the addition of protruding fins molded into the basic shape.
Figure 4A:
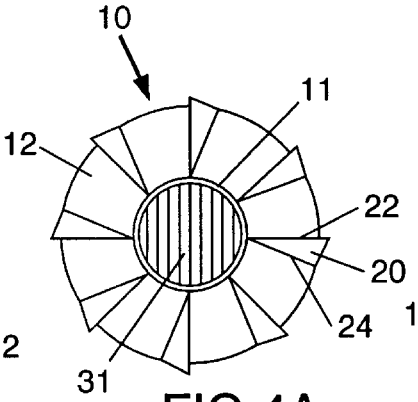
FIG. 4A and 4B are top plan views of the funnel shaped fletchings as described in FIG. 4 showing varying numbers of attached protruding fins molded into the basic form.
Figure 4B:
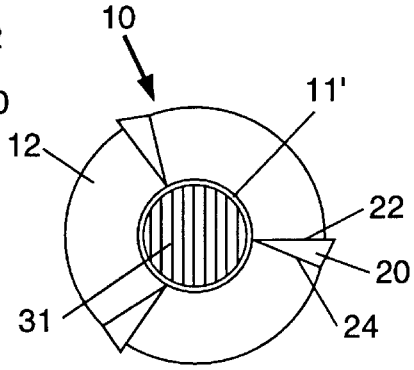
Figure 5:
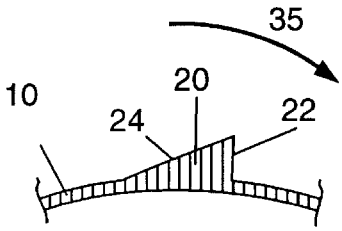
FIG. 5 is a cross section view, taken as indicated on line 5—5 of FIG. 4.

FIG. 4 is a side perspective view in accordance with the basic funnel shape as described in FIG. 2 with the addition of protruding wedge shaped fins 20 molded into the rear end 12 of the single piece fletching 10. The protruding fins 20 will be evenly spaced around the circumference of the single piece fletching 10. The number can vary from as many as eight fins as indicated in FIG. 4A (or more) to as few as three fins as indicated in FIG. 4B. These protruding fins 20 are comprised of two surfaces having different angles in relationship to the main body 10. These two surfaces are best illustrated in FIG. 5 which is cross-section view of the single piece fletching 10 taken at the line 5—5 of FIG. 4. Each protruding fin has one surface 22 that is flat or rather perpendicular to the center of the single piece fletching 10, and the other side 24 having a ramped surface angling outward or slightly less than tangent to the main body of the single piece fletching 10. These two surfaces create a wedge shape which start at a single point where the two basic parts 11 and 12 intersect and expand as they project rearward forming a triangular shaped fin having one flat side 22 and one angled side 24. Because of the different angles between the two surfaces more "drag"is created on one side of the fin 20 than the other. This difference causes the arrow to rotate or spin in the direction of surface 22 as indicated by arrow 35 (clockwise or counter clockwise depending on which side the different angles are placed) as it travels towards the target.

The inventor has found that by utilizing the single piece fletchings in accordance with the invention, an archer can attain superior groupings of arrows at both long and short distances. These superior groupings are mainly a result of two factors; the elimination of inconsistencies in the mounting processes attributed to multi-piece fletching systems, and the unique funnel shape of the fletching 10 that creates a complete 360 degree drag surface virtually eliminating flutter. Another advantage of the invention is its ease of application to the arrow shaft and eliminating the need for special jigs. The invention simply slides over the rear end of the arrow shaft and is taped in place.

While this invention has been disclosed with reference to its presently preferred embodiment, it is not limited thereto. Rather, this invention is limited only insofar as defined by the following set of claims and includes within its scope all equivalents thereof.

What is claimed:

1. An arrow comprising, in combination:

a) a substantially cylindrical shaft having front and rear ends;

b) a single piece fletching mounted with respect to said adjacent the rear end thereof;

c) said fletching having a cylindrical front part with a flared rear cone connected to said front part that projects back and outward defining a substantially larger circumference and providing said fletching with a funnel shaped appearance;

d) a plurality of fins disposed on said flared rear cone outwardly extending in fixed spaced relationship wherein said fins are angularly disposed with respect to each other and to a longitudinal axis of said fletching wherein each of said fins is of a wedge shaped cross section with a flat front directional face and a rearward sloping ramp face.

2. An arrow as defined in claim 1, wherein said fletching is of an injection molded plastic.

* * * * *